US008887334B1

(12) United States Patent
Schneidau et al.

(10) Patent No.: US 8,887,334 B1
(45) Date of Patent: Nov. 18, 2014

(54) APPENDAGE-SECURABLE PILLOW USING A BI-STABLE SPRING FASTENER

(71) Applicants: Timothy Schneidau, Arlington, VA (US); Heather Prattas, Surfside, FL (US)

(72) Inventors: Timothy Schneidau, Arlington, VA (US); Heather Prattas, Surfside, FL (US)

( * ) Notice: Subject to any disclaimer, the term of this patent is extended or adjusted under 35 U.S.C. 154(b) by 0 days.

(21) Appl. No.: 14/017,412

(22) Filed: Sep. 4, 2013

(51) Int. Cl.
*A47G 9/10* (2006.01)
*A47D 15/00* (2006.01)
*A47D 13/00* (2006.01)

(52) U.S. Cl.
CPC . *A47D 13/00* (2013.01); *A47G 9/10* (2013.01)
USPC ..... 5/655; 5/646

(58) Field of Classification Search
USPC ..... 5/655, 640, 643, 646, 647; 2/16; 63/3
See application file for complete search history.

(56) References Cited

U.S. PATENT DOCUMENTS

| | | | | |
|---|---|---|---|---|
| 4,393,520 | A | 7/1983 | Koch | |
| D315,845 | S * | 4/1991 | Lafley | D6/601 |
| 5,440,769 | A * | 8/1995 | Thomas | 5/655 |
| 5,845,804 | A * | 12/1998 | Prescott | 220/739 |
| 6,381,786 | B1 * | 5/2002 | Cadden | 5/655 |
| 6,425,494 | B1 * | 7/2002 | Woods, II | 220/739 |
| 6,918,148 | B2 | 7/2005 | Auxila | |
| 6,957,462 | B1 | 10/2005 | Wilcox | |
| 7,131,156 | B1 * | 11/2006 | Walker-Craft | 5/655 |
| 7,347,019 | B1 * | 3/2008 | Shaw | 40/607.01 |
| 7,426,764 | B2 * | 9/2008 | Ekins | 5/640 |
| 7,757,421 | B1 * | 7/2010 | Tompkins et al. | 42/96 |
| 8,162,383 | B2 * | 4/2012 | Curtis | 296/180.4 |
| 2005/0016210 | A1 * | 1/2005 | Weiss et al. | 63/3 |
| 2006/0179574 | A1 | 8/2006 | Margalit | |
| 2008/0313813 | A1 * | 12/2008 | Adiri et al. | 5/655 |
| 2010/0258601 | A1 * | 10/2010 | Thrope | 224/267 |

* cited by examiner

*Primary Examiner* — Michael Trettel
(74) *Attorney, Agent, or Firm* — Patents on Demand P.A.; Brian K. Buchheit; Scott M. Garrett

(57) ABSTRACT

A securable pillow can include a pillow having a top surface, bottom surface, and a filler material encased therein, and one or more bi-stable spring fastening mechanisms. The bi-stable spring fastening mechanisms can be attached to the bottom surface of the pillow. Activation of the bi-stable spring fastening mechanisms can substantially couple the pillow to the appendage of a user.

6 Claims, 3 Drawing Sheets

300

Cross-Sectional View, Deactivated Fastening Mechanism 305

Cross-Sectional View, Activated Fastening Mechanism 325

APPENDAGE-SECURABLE PILLOW USING A BI-STABLE SPRING FASTENER

BACKGROUND

The present invention relates to the field of pillows and, more particularly, to an appendage-securable pillow using a bi-stable spring fastener.

Pillows are commonly used to rest one's head upon, whether in bed or snuggling with another. Care-givers are known to use pillows when feeding or holding infants to provide the child with support and comfort like breast-feeding pillows. For other situations, such as holding a sleeping infant, a generic pillow is used like a throw pillow from a couch or a typical pillow used by an adult for sleeping. In such situations, the pillow is easily dislodged or shifted by the movements of either party and often gets in the way should the person need to rise and walk around.

A variety of pillows have been proposed to combat the problem of not being able to have the pillow remain relatively stationary should the person or infant move about. However, these pillows tend to use fastening mechanisms that are time-consuming or are difficult to manipulate with a single hand. For example, it is generally difficult for a person to tie an item onto their own arm; buckles are often difficult to manipulate with one hand.

BRIEF SUMMARY

One aspect of the present invention can include a securable pillow that includes a pillow having a top surface, bottom surface, and a filler material encased therein, and one or more bi-stable spring fastening mechanisms. The bi-stable spring fastening mechanisms can be attached to the bottom surface of the pillow. Activation of the bi-stable spring fastening mechanisms can substantially couple the pillow to the appendage of a user.

Another aspect of the present invention can include a method that begins by placing the bottom surface of a securable pillow upon the appendage of a first user. One or more bi-stable spring fastening mechanisms can be attached to the bottom surface. Placement of the securable pillow can position the bi-stable spring fastening mechanisms tangential to the circumference of the appendage. The bi-stable spring fastening mechanisms can then be activated. Upon activation, the bi-stable spring fastening mechanisms can coil substantially around the circumference of the appendage of the first user, coupling the securable pillow to the appendage. A portion of the body of a second user can then rest upon a top surface of the securable pillow. The placement of the securable pillow can remain substantially unchanged when the second user moves upon the top surface.

Yet another aspect of the present invention can include a system for holding an infant that includes a securable pillow and an infant. The securable pillow can be coupled to the interior surface of the arm of a person by means of one or more bi-stable spring fastening mechanisms. The infant can be held by the person and have a portion of its body resting upon the securable pillow. Placement of the securable pillow upon the arm of the person can be substantially unaffected by the movements of the infant.

DETAILED DESCRIPTION

Figure 1A:
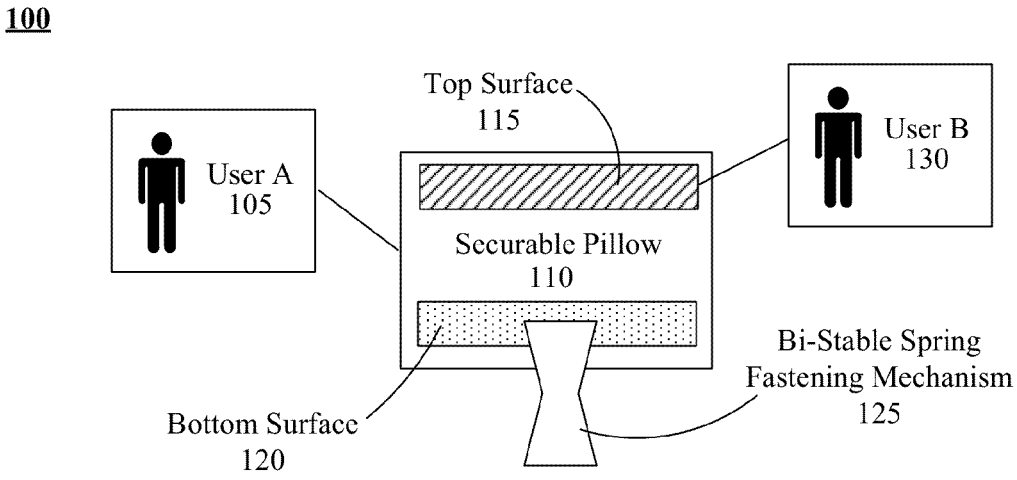
FIG. 1A is an illustration of the usage of a securable pillow with an infant in accordance with embodiments of the inventive arrangements disclosed herein.

The present invention discloses a pillow that can be secured to a person's appendage using a bi-stable spring fastening mechanism (e.g., like a "slap bracelet"). Once the pillow is properly positioned on the appendage, the bi-stable spring fastening mechanism can be activated. The bi-stable spring fastening mechanism can wrap around a substantial portion of the appendage. The bi-stable spring fastening mechanism can help to keep the pillow in its position on the appendage while the person moves about or when another person is resting upon the pillow.

In one embodiment, a head or body of an infant can rest on the pillow, which is attached to a care givers forearm. A concavity for infant head/body stability can be built into the shape of the pillow.

In one embodiment, the pillow portion can rest between a caregiver's arm and a support, where the infant rests directly on the care giver's arm. In this embodiment, a caregiving can support their arm on a chair rest, table, or other support surface using the pillow as a spacing mechanism to achieve a desired height. In absence of the pillow and the increased elevation, the care giver's arm would not be able to rest against the supporting surface while the infant is being cradled/held by the caregiver.

As used herein, a bi-stable spring is a structure that has two stable mechanical shapes. The bi-stable spring can be stabled by different curvature axes. A common example of a bi-stable spring is a snap bracelet, slap bracelet, or trouser clip. In one embodiment, one stable shape of the bi-stable spring is a long tube-like structure, where the other stable shape is a rolled up cylinder or half cylinder shape. When in the cylinder shape, a bi-stable spring is able to remain stably fastened to an appendage of a wearer.

Embodiments of the disclosure are contemplated, where the bi-stable spring is the only supporting mechanism keeping the pillow attached to a wearer's appendage. Embodiments are also contemplated, where additional securing mechanisms exist for enhanced stability, such as additional fasteners like a hook-and-loop fastener, one or more snaps, or other couplers. In such embodiments, the bi-stable spring can initially position the pillow in a hands-free fashion along the appendage until additional fasteners/couplers can be properly secured.

It should be appreciated that specific application of the bi-stable spring as for an infant care device is especially significant as caregivers often have their hands full (with caring for an infant) and are in a rush to handle infant based emergencies. Further, caregivers of infants are often lacking in sleep, yet have an extraordinary degree of accountability due to the critical nature of caring for infants. The ability to secure a pillow without resorting to time consuming (and arm requiring) fastening mechanisms and to selectively and easily remove the pillow with minimal hassle can minimize accidents, such as dropping an infant or having an infant's poorly supported head accidently being jerked in awkward positions.

As will be appreciated by one skilled in the art, aspects of the present invention may be embodied as a system or method. Aspects of the present invention are described below with reference to flowchart illustrations and/or block diagrams of methods and apparatus (systems) according to embodiments of the invention.

Figure 1B:
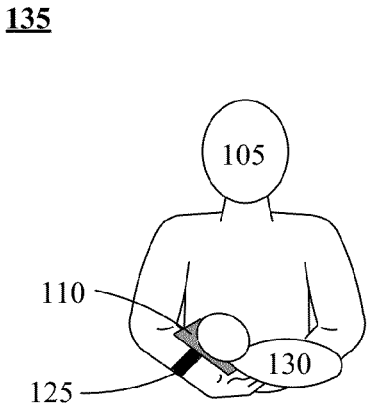
FIG. 1B is an illustration of the usage of a securable pillow with an infant in accordance with embodiments of the inventive arrangements disclosed herein.

FIG. 1 is a schematic diagram illustrating a system 100 for utilizing a securable pillow 110 having a bi-stable spring fastening mechanism 125 in accordance with embodiments of the inventive arrangements disclosed herein. In system 100, a first person, User A 105, can couple the securable pillow 110 to themselves and a second person, User B 130, can rest upon the coupled securable pillow 110. In one contemplated embodiment, User A 105 can be a caregiver, while User B is an infant, as shown in examples 135 and 140 of FIGS. 1A and 1B.

The securable pillow 110 can include a pillow or cushion portion that has at least a top surface 115 and a bottom surface 120 and one or more bi-stable spring fastening mechanisms 125.

The pillow portion can be made using a variety of shapes and materials. In one contemplated embodiment, the top surface 115 of the securable pillow 110 can have a pre-shaped depression of a size and shape to accommodate the head and/or body of an infant or small child. Thus, a concave depression can exist in the securable pillow 110. In one embodiment, the top surface 115 of the securable pillow 110 can be approximately (plus or minus 25 percent angle or curve) planar as is the case with a "typical" or normal pillow. In another embodiment, a convex shape can be used for the top surface 115, as a convex shape is likely more beneficial for embodiments (see FIG. 1B) where the pillow is used as a spacer against a support surface 142.

In various embodiments, the pillow 110 can be constructed using a compressible material having elastic deformation properties. In various embodiments, the pillow 110 can utilize materials of: cotton, down, feathers, wool, horsehair, polyester, Hollofill™ (a continuous filament fiber with a hollow core), polyester pellets, microbeads, polystyrene beads, low-density foam materials (like those used for a BUMBO™), memory foam, viscoelactic polyurethane foam, low-resilience polyurethane foam, sorbothane, neoprene, and other foams, shredded rubber, buckwheat, millet, flaxseed, lavender, and other fillers.

Additionally, the securable pillow 110 can specifically be breathable (to reduce heat/sweating), washable, antimicrobial, hypoallergenic, stain resistant, and the like. In one embodiment, the securable pillow 110 can be designed with removable pillows (for easy replacement) and/or with removable pillow covers.

The one or more bi-stable spring fastening mechanisms 125 can be attached to the bottom surface 120 of the securable pillow 110. A bi-stable spring fastening mechanism 125 can represent a means that utilizes at least one bi-stable spring to couple the bottom surface 120 of the securable pillow 110 to User A's 105 appendage. Bi-stable springs, commonly known as "snap" or "slap" bracelets, are well known in the art, and, as such, will not be discussed in great detail herein. The bistable spring 125 can be coated with a softening material, such as a rubberized plastic or other coating (as opposed to being raw metal). Coating(s) optionally used for the bi-stable spring can be designed to enhance comfort, to prevent pinching, to minimize clean up, and the like.

Attachment of the bi-stable spring fastening mechanism 125 to the bottom surface 120 can be achieved using means suitable for the use of the securable pillow 110 as well as the comprised materials. That is, techniques that create a strong and resilient bond should be used to attach the bi-stable spring fastening mechanism 125 to the bottom surface 120.

For example, the bi-stable spring fastening mechanism 125 can be sewn into an outer covering of the bottom surface 120. As another example, the bi-stable spring fastening mechanism 125 can be attached to the bottom surface 120 using a suitable adhesive.

As shown in example 135 of FIG. 1A, the bi-stable spring fastening mechanism 125 can wrap around a substantial portion of the circumference of an appendage of User A 105 like an arm. The length of the bi-stable spring fastening mechanism 125 used can be varied to produce a securable pillow 110 that is better able to wrap around larger appendages like the thigh of a leg.

As shown in example 140 of FIG. 1B, pillow 110 portion can function as a spacer to elevate an appendage of User A relative to a support surface 142. This spacing permits the arm or other appendage to rest substantially more comfortably compared to the alternative (of no spacing). Note, many rocking chairs and other supports are typically not constructed at heights appropriate for infant caregivers, and the use of a spacing element, such as shown in FIG. 1B can greatly alleviate/minimize fatigue. Embodiments are contemplated that include both spacers (for support elevation) and infant head/body support. A single element (pillow 110) is able to function as both support and elevation in contemplated embodiments depending on user A positioning of the pillow 110.

In another embodiment, the bi-stable spring fastening mechanism 125 can have a covering to protect the internal mechanics from tampering as well as prohibit skin and/or body hair from becoming caught and pinched. This covering can also include cushioning to increase User A's 105 comfort when the bi-stable spring fastening mechanism 125 is activated, as the bi-stable spring fastening mechanism 125 can exert some pressure upon the appendage. Further, the cushioning can also help to counteract the pressure caused by the weight of User B 130 that is focused on the bi-stable spring fastening mechanism 125.

In yet another embodiment, the bi-stable spring fastening mechanism 125 can include a locking mechanism that provides additional security against accidental deactivation of the bi-stable spring fastening mechanism 125. For example, opposite, overlapping elements of the bi-stable spring fastening mechanism 125 can have a hook and look fastener (e.g., VELCRO), snaps, or clasps that are engaged after the bi-stable spring fastening mechanism 125 has been activated.

In another contemplated embodiment, the bi-stable spring fastening mechanism 125 can have two separate and independently-operating bi-stable spring elements.

In still another embodiment, the securable pillow 110 can utilize multiple bi-stable spring fastening mechanisms 125 that couple at different locations on the appendage.

Figure 2:
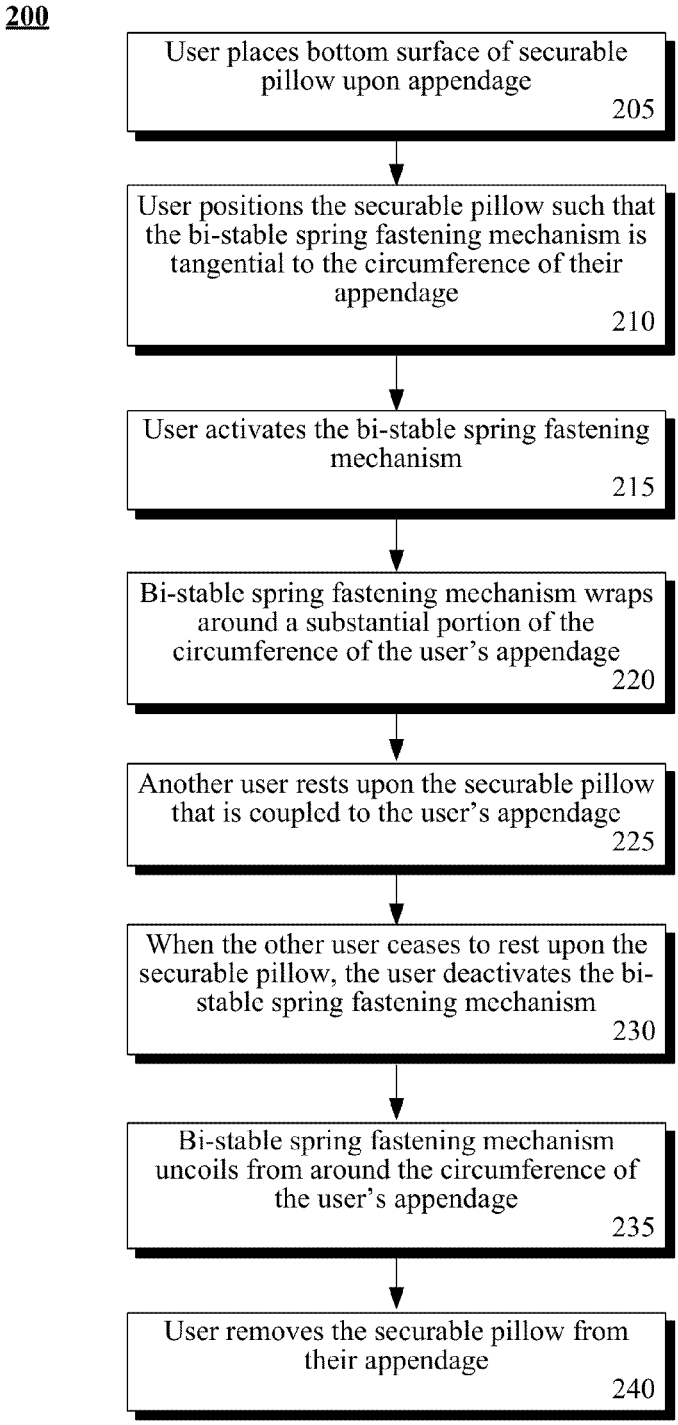
FIG. 2 is a flowchart of a method that describes the use of the securable pillow in accordance with an embodiment of the inventive arrangements disclosed herein.

FIG. 2 is a flowchart of a method 200 that describes the use of the securable pillow in accordance with embodiments of the inventive arrangements disclosed herein. Method 200 can be performed within the context of system 100.

Method 200 can begin in step 205 where the user can place the bottom surface of the securable pillow upon their appendage. The securable pillow can be positioned such that the bi-stable spring fastening mechanism is tangential to the circumference of their appendage in step 210. Without the positioning as described in step 210, the strength of the coupling of the securable pillow to the user's appendage can be compromised.

In step 215, the user can activate the bi-stable spring fastening mechanism. Activation of the bi-stable spring fastening mechanism can be achieved by the user applying the necessary amount of force required to transition the bi-stable springs within the bi-stable spring fastening mechanism from a first state (deactivated or uncoiled) to a second state (activated or coiled). The bi-stable spring fastening mechanism can include visual cues upon its surface to direct the user to apply the force in the appropriate location.

The bi-stable spring fastening mechanism can wrap around a substantial portions of the circumference of the user's appendage in step 220, coupling the securable pillow to the user's appendage. In step 225, another user can then rest comfortably upon the securable pillow that has been coupled to the user's appendage.

When the other user ceases to rest upon the securable pillow, the user can deactivate the bi-stable spring fastening mechanism in step 230. Deactivation of the bi-stable spring fastening mechanism can include applying the necessary amount of force required to transition the bi-stable springs within the bi-stable spring fastening mechanism from the second state (activated or coiled) to the first state (deactivated or uncoiled). The deactivation force can be applied in the same location as the activation force or in another location on the bi-stable spring fastening mechanism.

In step 235, the bi-stable spring fastening mechanism can uncoil from around the circumference of the user's appendage. The user can then remove the securable pillow from their appendage in step 240.

The steps of method 200 can be utilized when performing a variety of activities such a feeding an infant, soothing or comforting an infant or child, holding a sleeping infant or child, watching movies or television, and so on.

Figure 3A:
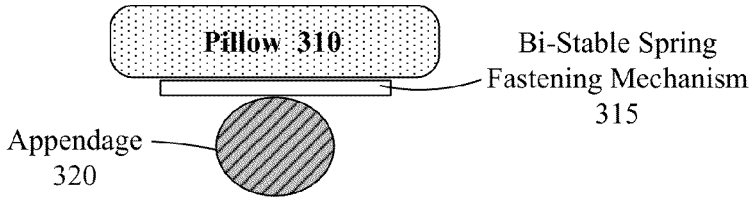
FIG. 3A,B is a collection 300 of cross-sectional views of the bi-stable spring fastening mechanism states in accordance with an embodiment of the inventive arrangements disclosed herein.
Figure 3B:
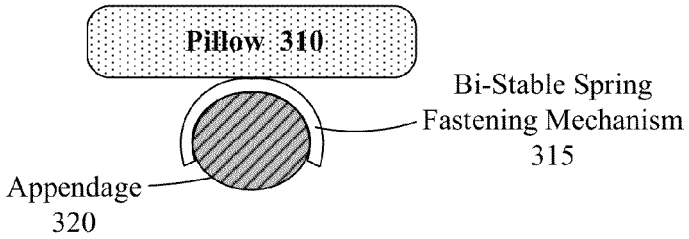

FIG. 3A,B is a collection 300 of cross-sectional views 305 and 325 of the bi-stable spring fastening mechanism 315 states in accordance with embodiments of the inventive arrangements disclosed herein. Although the cross-sectional views 305 and 325 of collection 300 indicate use of a single bi-stable spring fastening mechanism 315, it should be noted that multiple bi-stable spring fastening mechanisms 315 can be used and can be independently transitioned between the illustrated states.

Cross-sectional view 305 can illustrate the securable pillow 310 with the bi-stable spring fastening mechanism 315 in the deactivated state. As described in method 200, the bi-stable spring fastening mechanism 315 can be positioned tangential to the circumference of the user's appendage 320. That is, the position of the bi-stable spring fastening mechanism 315 can be such to allow the bi-stable spring fastening mechanism 315 to wrap around the circumference of the appendage 320 when activated, as shown in cross-sectional view 325.

In the activated state shown in cross-sectional view 325, the bi-stable spring fastening mechanism 315 can couple the pillow 310 to the user's appendage 320. The bi-stable spring fastening mechanism 315 can dynamically change its shape from the flattened, deactivated state of view 305 to the coiled, activated state of view 325 in response to a triggering force provided by the user.

The flowchart and block diagrams in the Figures illustrate the architecture, functionality, and operation of possible implementations of systems and methods according to various embodiments of the present invention. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

What is claimed is:

1. A method comprising:

placing a bottom surface of a securable pillow upon an appendage of a first user, wherein at least one bi-stable spring fastening mechanism is attached to the bottom surface, wherein the placement of the securable pillow positions the at least one bi-stable spring fastening mechanism tangential to a circumference of the appendage;

activating the at least one bi-stable spring fastening mechanism, wherein, upon said activation, the at least one bi-stable spring fastening mechanism coils substantially around the circumference of the appendage of the first user, wherein the securable pillow is substantially coupled to the appendage; and resting a portion of a body of a second user upon a top surface of the securable pillow, wherein the placement of the securable pillow remains substantially unchanged when the portion of the body of the second user moves upon the top surface.

2. The method of claim 1, wherein the resting of the portion of the body of the second user comprises resting a head, a shoulder, or a back of the second user, which is an infant or a child, upon the top surface of the securable pillow.

3. The method of claim 1, wherein activating the at least one bi-stable spring fastening mechanism further comprises:

applying at least a minimum amount of force required to transition bi-stable springs comprising the at least one bi-stable spring fastening mechanism from a first state to a second state, wherein, in the first state, the at least one bi-stable spring fastening mechanism is substantially flattened and, in the second state, the at least one bi-stable spring fastening mechanism is substantially coiled.

4. The method of claim 1, wherein activating the at least one bi-stable spring fastening mechanism further comprises:

after the at least one bi-stable spring fastening mechanism has been activated, engaging a locking mechanism that prevents the activated at least one bi-stable spring fastening mechanism from accidentally deactivating.

5. The method of claim 1, further comprising:

once the portion of the body of the second user is removed from the top surface of the securable pillow, deactivating the at least one bi-stable spring fastening mechanism to decouple the securable pillow from the appendage of the first user.

6. The method of claim 5, wherein deactivating the at least one bi-stable spring fastening mechanism further comprises:

applying at least a minimum amount of force required to transition bi-stable springs comprising the at least one bi-stable spring fastening mechanism from a second state to a first state, wherein, in the first state, the at least one bi-stable spring fastening mechanism is substantially flattened and, in the second state, the at least one bi-stable spring fastening mechanism is substantially coiled.

* * * * *